US010008137B2

(12) United States Patent
Cheng et al.

(10) Patent No.: US 10,008,137 B2
(45) Date of Patent: Jun. 26, 2018

(54) ILLUMINATED SIGN WITH COMPARTMENTED PORTION

(71) Applicant: LITE-ON TECHNOLOGY CORPORATION, Taipei (TW)

(72) Inventors: Yi-Kai Cheng, Taipei (TW); Kuo-Hui Chang, Taoyuan (TW); Ching-Tsung Ni, Taoyuan (TW); Shih-Chang Wang, New Taipei (TW)

(73) Assignee: LITE-ON TECHNOLOGY CORPORATION, Taipei (TW)

( * ) Notice: Subject to any disclaimer, the term of this patent is extended or adjusted under 35 U.S.C. 154(b) by 266 days.

(21) Appl. No.: 14/862,896

(22) Filed: Sep. 23, 2015

(65) Prior Publication Data

US 2016/0273732 A1 Sep. 22, 2016

(30) Foreign Application Priority Data

Mar. 18, 2015 (TW) ..... 104204037 U

(51) Int. Cl.
*G09F 13/04* (2006.01)

(52) U.S. Cl.
CPC ..... *G09F 13/0413* (2013.01); *G09F 13/04* (2013.01); *G09F 13/0409* (2013.01)

(58) Field of Classification Search
CPC ..... G09F 13/0404; G09F 13/0409; G09F 13/0413; G09F 13/0445; G09F 13/08; F21V 13/00; F21V 13/02; F21V 13/04; F21V 13/08; G02B 3/0056; G02B 5/021; G02B 5/0215; G02B 5/0278
See application file for complete search history.

(56) References Cited

U.S. PATENT DOCUMENTS 4,854,062 A * 8/1989 Bayo ..... G09F 9/33 40/551
5,816,681 A * 10/1998 Tedesco ..... F21S 48/215 362/293
6,042,248 A * 3/2000 Hannah ..... G09F 13/0404 362/235
6,631,575 B1 * 10/2003 Voelzke ..... G09F 9/33 40/451
6,924,973 B2 * 8/2005 Kim ..... F21K 9/00 361/728
6,964,507 B2 * 11/2005 Mohacsi ..... F21K 9/00 362/240
7,118,251 B1 * 10/2006 Chambers ..... G09F 13/0404 362/311.02
7,175,305 B2 * 2/2007 Martineau ..... F21V 7/09 362/244

(Continued)

*Primary Examiner* — Ismael Negron

(74) *Attorney, Agent, or Firm* — Li & Cal Intellectual Property (USA) Office

(57) ABSTRACT

The illuminated sign includes a frame defining a space, a light emitting module received in the space and having a plurality of light emitting members disposed on a circuit substrate, an optical path conversion component provided on the frame to correspond to the light emitting members, and a light uniformizing component positioned a distance above the optical path conversion component. The space is compartmented to form a predetermined pattern, projecting a desired signal when the light emitting members in different compartments of the space are selectively illuminated.

18 Claims, 12 Drawing Sheets

(56) References Cited

U.S. PATENT DOCUMENTS

| | | | | |
|---|---|---|---|---|
| 7,186,004 | B2 * | 3/2007 | Powell | G02B 3/0025 359/365 |
| 7,241,031 | B2 * | 7/2007 | Sloan | G09F 13/0404 362/240 |
| 7,927,001 | B2 * | 4/2011 | Choi | G02B 5/0215 362/616 |
| 8,188,503 | B2 * | 5/2012 | Lynch | G06F 1/189 257/99 |
| 8,449,142 | B1 * | 5/2013 | Martin | G09F 13/22 362/217.1 |

* cited by examiner

ILLUMINATED SIGN WITH COMPARTMENTED PORTION

BACKGROUND OF THE INVENTION

1. Field of the Invention

The instant disclosure relates to an indicating device; in particular, to an indicating device which can reduce amounts of LEDs and has superior light emitting uniformity to show an indicating pattern.

2. Description of Related Art

At present, LEDs are widely used in traffic signal light on the roads. Compared to traditional light bulbs, a LED light not only has superior luminous efficiency, but also has advantages such as long lifetime and low power consumption.

An existing LED type traffic signal light utilizes the LEDs for showing an indicating pattern. For example as the traffic signal light disposed on the road intersection for regulating pedestrians, a human shape pattern is used for indicating the pedestrian who can across the road, or a palm shape pattern is used for indicating the pedestrian who cannot across the road, wherein the human and palm shape patterns are formed by arrangement of the LEDs. Due to the LED has higher directivity, and swarms of arranged LEDs need to be utilized to form the indicating pattern having an emitting light with uniformity. For example, it needs 75 and 120 LEDs for showing the human and palm pattern respectively.

Therefore, when conducting lines are laid to drive these LEDs, the amounts of contact points being the same as the amounts of LEDs should be arranged on the circuit substrate, and these LEDs are assembled and welded to the corresponding contact points by repeatedly execute the same procedure, respectively. In this way, the manufacturing cost and working complexity are increased. Besides, in order to avoid the indicating pattern having uneven light emitting brightness, when choosing the LEDs, the LEDs having similar brightness should be selected, it also increase the difficulty to choose the LEDs.

SUMMARY OF THE INVENTION

An embodiment of the instant disclosure provides an indicating device which can adjust light distribution by an optical path conversion component and a light uniformizing component, so as to reduce amounts of light emitting members. Moreover, even though the amounts of the light emitting members are reduced, its brightness and uniformity also can meet the specification requirements.

The indicating device of the embodiment of the instant disclosure includes a circuit substrate, a frame, a light emitting module, an optical path conversion component, and a light uniformizing component. The frame is disposed on the circuit substrate, wherein the frame has an accommodating space for forming a predetermined pattern. The light emitting module includes a plurality of light emitting members disposed dispersedly on the circuit substrate and received in the accommodating space. The optical path conversion component is disposed on the frame, wherein the optical path conversion component has a plurality of optical path conversion structures respectively corresponding to the light emitting members, and the optical path conversion structures arrange into an indicating pattern which corresponds to the predetermined pattern. The light uniformizing component is disposed above the optical path conversion component, and the light uniformizing component and the optical path conversion component are separated apart from each other to define a predetermined distance. Each of the light emitting members generates a divergent light beam passing through the corresponding optical path conversion structures to collimate into a parallel light beam, and the parallel light beams are adjusted into non-parallel light beams through the light uniformizing component for forming a uniform light emission surface presenting the indicating pattern.

The indicating device of another embodiment of the instant disclosure includes a circuit substrate, a frame, a light emitting module, an optical path conversion component, and a light uniformizing component. The frame is disposed on the circuit substrate, wherein the frame has a first accommodating space, a second accommodating space, and a third accommodating space, the first and third accommodating spaces are cooperatively formed with a first predetermined pattern, and the second and third accommodating spaces are cooperatively formed with a second predetermined pattern, wherein the first predetermined pattern and the second predetermined pattern are partially reciprocally overlapping. The light emitting module includes a plurality of first light emitting members and a plurality of second light emitting members, wherein the first light emitting members are disposed dispersedly on the circuit substrate and are received in the first and third accommodating spaces, and the second light emitting members are disposed dispersedly on the circuit substrate and are received in the second and third accommodating spaces. The optical path conversion component is disposed on the frame, wherein the optical path conversion component has a plurality of first optical path conversion structures, a plurality of second optical path conversion structures, and a plurality of third optical path conversion structures, each of the first optical path conversion structures corresponds to the corresponding first light emitting member received in the first accommodating space, each of the second optical path conversion structures corresponds to the corresponding second light emitting member received in the second accommodating space, and each of the third optical path conversion structures corresponds to the corresponding first and second light emitting members received in the third accommodating space, wherein the first and third optical path conversion structures arrange into a first indicating pattern which corresponds to the first predetermined pattern, and the second and third optical path conversion structures arrange into a second indicating pattern which corresponds to the second predetermined pattern. The light uniformizing component is disposed above the optical path conversion component, and the light uniformizing component and the optical path conversion component are separated apart from each other to define a predetermined distance. Each of the first light emitting members generates a first divergent light beam passing through the corresponding first and third optical path conversion structures to collimate into a first parallel light beam, and the first parallel light beams are adjusted into non-parallel light beams through the light uniformizing component for forming a first uniform light emission surface presenting the first indicating pattern. Additionally, each of the second light emitting members generates a second divergent light beam passing through the corresponding second and third optical path conversion structures to collimate into a second parallel light beam, and the second parallel light beams are adjusted into non-parallel light beams through the light uniformizing component for forming a second uniform light emission surface presenting the second indicating pattern.

The invention has a beneficial effect that, via the optical path conversion component and the light uniformizing component are disposed at the indicating device of the instant disclosure, the indicating device can uniformize the brightness of the light emission surface of the indicating device. Hence, the amounts of the LEDs and the repeat times of the same procedures can be reduced, so as to save manufacturing cost and assembling time.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Embodiments of "an indicating device" disclosed in the instant disclosure are illustrated via specific examples as follows, and people familiar in the art may easily understand the advantages and efficacies of the instant disclosure by disclosure of the specification. The instant disclosure may be implemented or applied by other different specific examples, and each of the details in the specification may be applied based on different views and may be modified and changed under existence of the spirit of the instant disclosure. The figures in the instant disclosure are only for brief description, but they are not depicted according to actual size and do not reflect the actual size of the relevant structure. The following embodiments further illustrate related technologies of the instant disclosure in detail, but scopes of the instant disclosure are not limited herein.

Figure 1A:
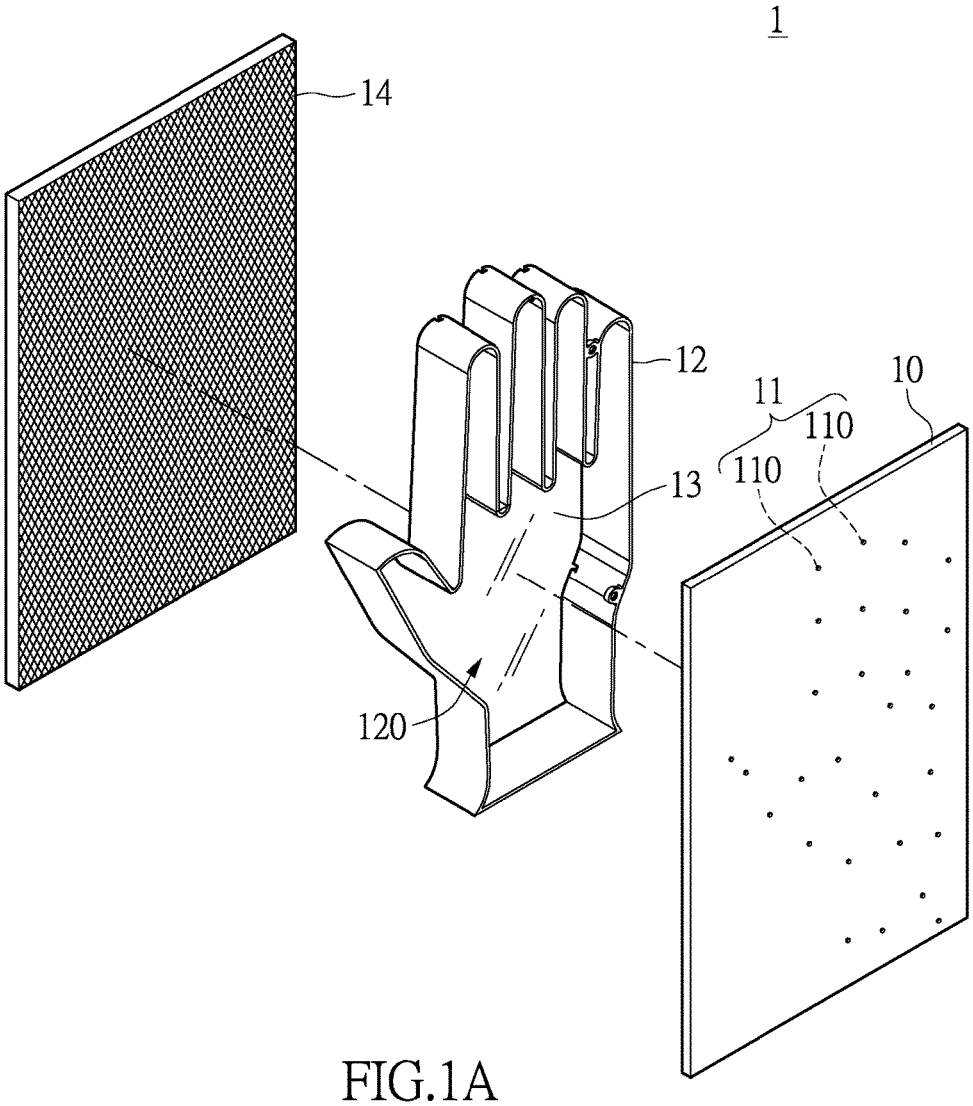
FIG. 1A shows an exploded perspective view of a signal indicator of an embodiment in the instant disclosure.
Figure 1B:
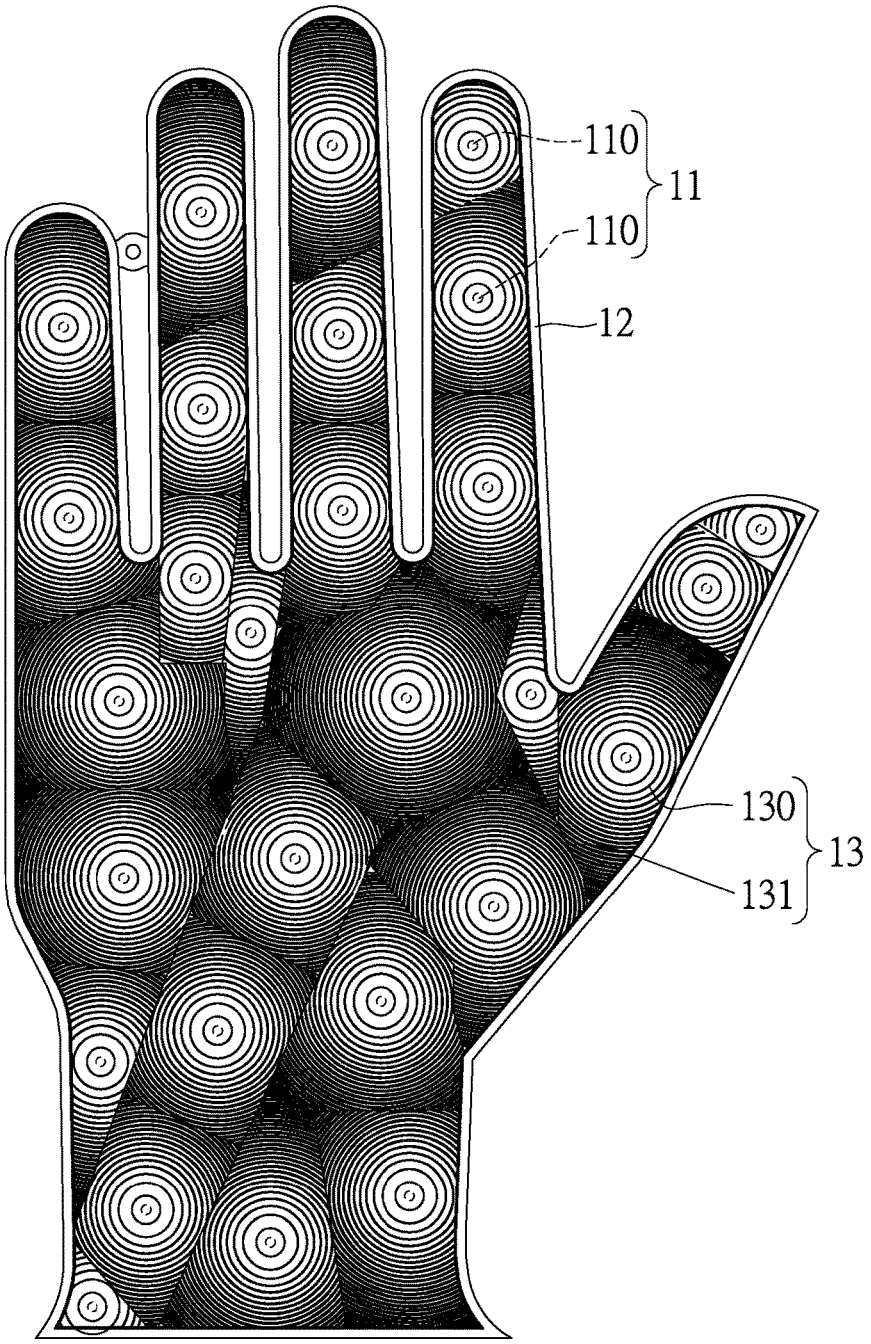
FIG. 1B shows a partial schematic plan view of the signal indicator of FIG. 1A without a light uniformizing component.
Figure 1C:
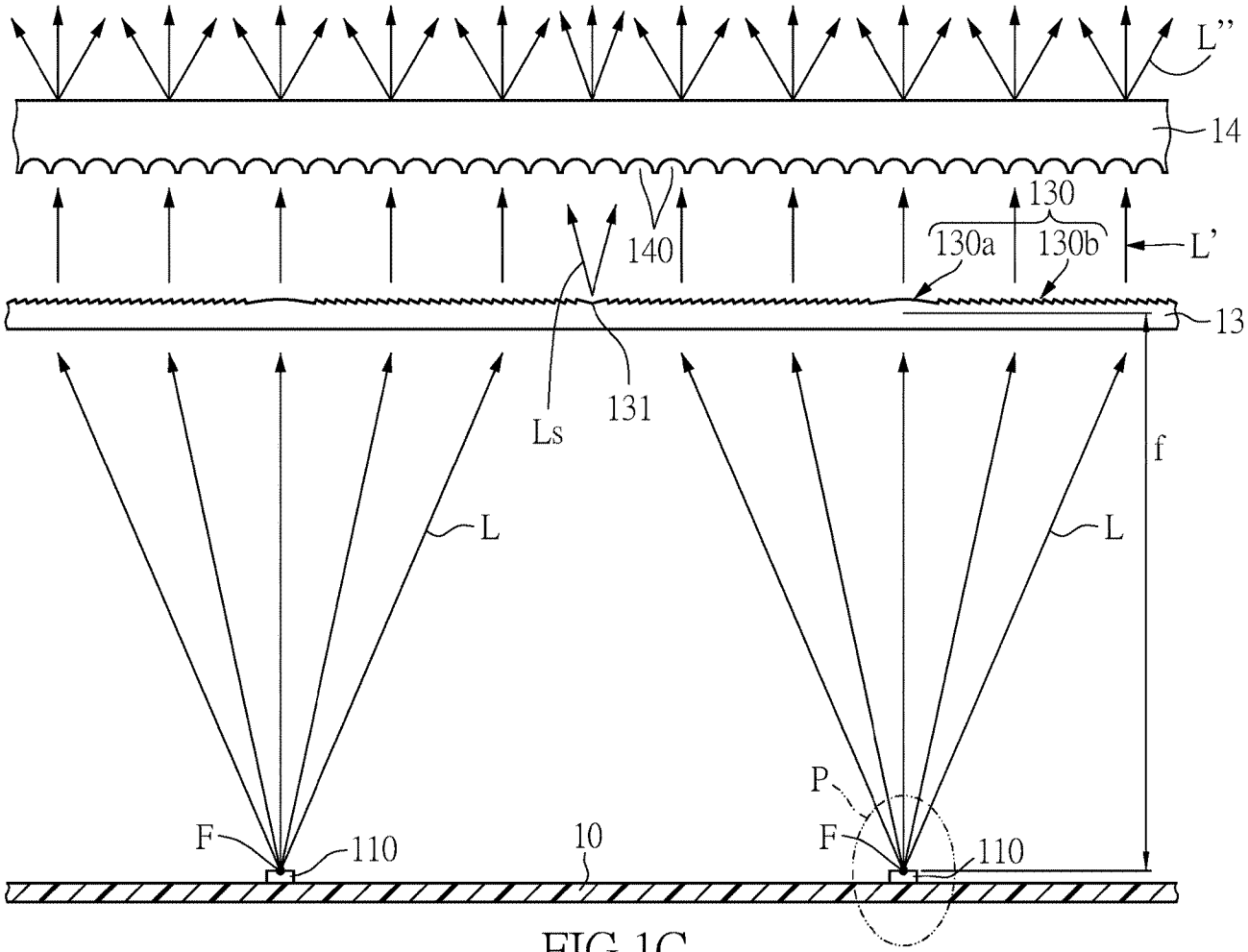
FIG. 1C shows a partial cross-sectional schematic view of the signal indicator of FIG. 1A.
Figure 2A:
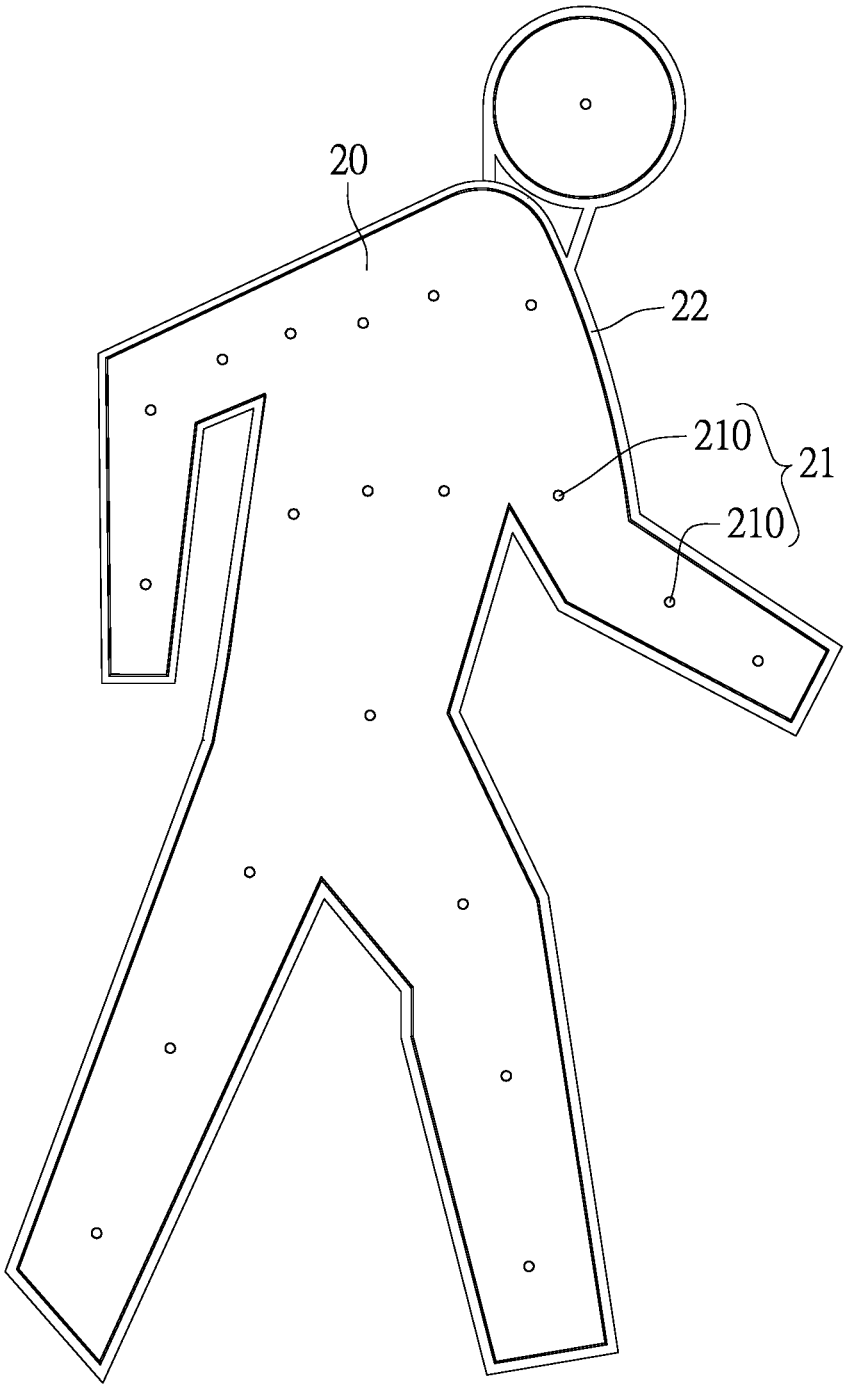
FIG. 2A shows a partial schematic plan view of a signal indicator without a light uniformizing component and an optical path conversion component of an another embodiment in the instant disclosure.
Figure 2B:
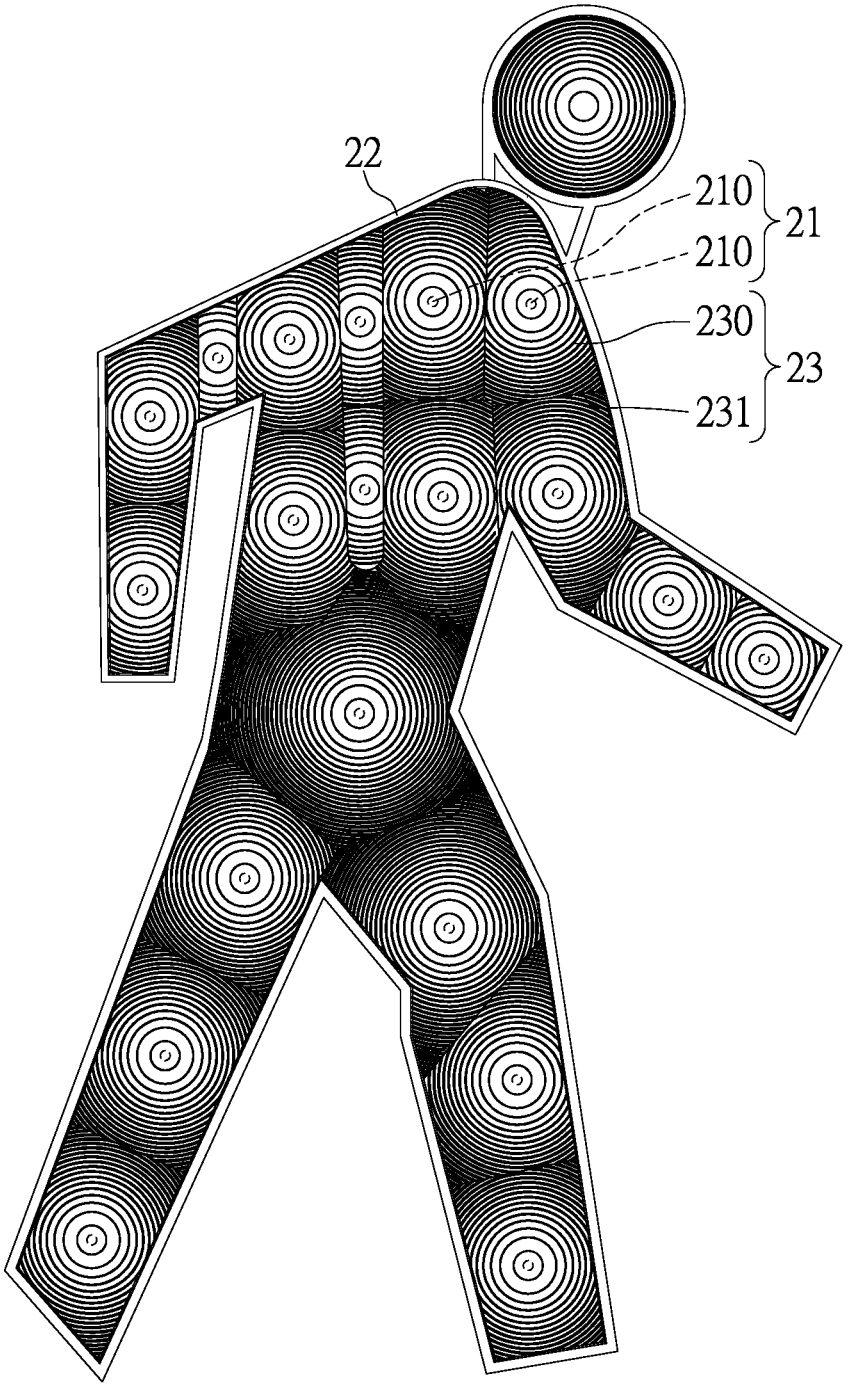
FIG. 2B shows a partial schematic plan view of the signal indicator without the light uniformizing component of the another embodiment in the instant disclosure.

An indicating device of an embodiment in the instant disclosure may be a signal indicator or other indicators using LEDs to arrange a display pattern. The signal indicator will be as an embodiment of the instant disclosure to be illustrated hereinafter. Please refer to FIGS. 1A to 1C, and FIGS. 2A to 2B. FIG. 1A shows an exploded perspective view of a signal indicator of an embodiment in the instant disclosure, FIG. 1B shows a partial schematic plan view of the signal indicator of FIG. 1A without a light uniformizing component, and FIG. 1C shows a partial cross-sectional schematic view of the signal indicator of FIG. 1A. FIG. 2A shows a partial schematic plan view of a signal indicator without a light uniformizing component and an optical path conversion component of an another embodiment in the instant disclosure, and FIG. 2B shows a partial schematic plan view of the signal indicator without the light uniformizing component of the another embodiment in the instant disclosure.

The signal indicator 1 of FIG. 1A includes a circuit substrate 10, a light emitting module 11, a frame 12, an optical path conversion component 13, and a light uniformizing component 14. Examples of the circuit substrate 10 include, but are not limited to a Printed Circuit substrate (PCB), a Flexible Printed Circuit substrate (FPCB), and a Metal Core Printed Circuit substrate (MCPCB).

The frame 12 has an accommodating space 120 for forming a predetermined pattern. Examples of the predetermined pattern include, but are not limited to a human shape, a palm shape, a round shape, and any other shape. The frame 12 is disposed on the circuit substrate 10 for defining a range of the light emitting module 11 disposed therein. In the embodiment of FIG. 1A, the frame 12 defines the predetermined pattern having the palm shape. In another embodiment, as shown in FIG. 2A, the frame 22 of the signal indicator of FIG. 2A defines the predetermined pattern having the human shape.

In the embodiment of FIG. 1A, the light emitting module 11 includes a plurality of light emitting members 110 disposed dispersedly on the circuit substrate 10 and received (or placed) in the accommodating space 120. Additionally, in the embodiment of FIG. 2A, the light emitting module 21 also includes a plurality of light emitting members 210 disposed dispersedly on the circuit substrate 20. Please refer to FIG. 1A and FIG. 2A, in the embodiments, the light emitting members 110, 210 are high-power LEDs. The light emitting members 110, 210 may be assembled on the circuit substrates 10, 20 using a surface-mounted technology (SMT). The light emitting members 110, 210 can electrically connect to a control member (not shown) via conducting lines of the circuit substrates 10, 20. The light emitting members 110, 210 can be turned on or off by controlling the abovementioned control member.

The light emitting members 110, 210 can emit visible lights. Furthermore, depending on the application needs, the light emitting members 110, 210 can selectively emit different colors of LEDs such as red, green, yellow, blue, and white. For example, when the signal indicator of the embodiment in the instant disclosure is used for a traffic signal light, the light emitting members 110, 210 can generate red lights and green lights respectively.

In addition, the light emitting members 110, 210 are disposed in the accommodating space depending on the predetermined pattern which is disposed at different positions. As shown in FIG. 1A and FIG. 1B, the predetermined pattern has the palm shape and the predetermined pattern is divided into a plurality of different areas. Each of the areas is designated with one light emitting member 110, and these light emitting members 110 can respectively provide brightness for different areas. Hence, when the light emitting members 110 are disposed in the accommodating space 120, the light emitting members 110 are disposed dispersedly in the predetermined pattern defined by the frame 12 depending on the needs.

Please refer to FIG. 1B, the optical path conversion component 13 has a plurality of optical path conversion structures 130 corresponding to the light emitting members 110. That is, the optical path conversion structures 130 are disposed depending on the divided areas in the predetermined pattern, and all of the optical path conversion structures 130 are combined and arranged into an indicating pattern corresponding to the abovementioned predetermined pattern. For example, in the embodiment, the predetermined pattern of the frame 12 has the palm shape, and the indicating pattern of the optical path conversion structures 130 are arranged into the palm shape corresponding to the predetermined pattern.

The optical path conversion component 13 is disposed on the frame 12. Furthermore, the frame 12 has a height so that when the optical path conversion component 13 is disposed on the frame 12, the optical path conversion component 13, the circuit substrate 10, and the light emitting module 11 disposed on the circuit substrate 10 are separated by a distance.

However, in the embodiment of FIG. 2B, the predetermined pattern of the frame 22 has the human shape, and the indicating pattern cooperatively formed by the optical path conversion structures 230 of the optical path conversion component 23 is formed into the human shape corresponding to the predetermined pattern. It should be noted that, the optical path conversion structures 130, 230 of FIG. 1B and FIG. 2B are connected with each other, and each two of the optical path conversion structures 130, 230 has a connecting line 131, 231 therebetween.

Please refer to FIG. 1B, in the embodiment, the optical path conversion structure 130 is a condensing lens such as a Fresnel lens. Besides, in the embodiment of the instant disclosure, each of the Fresnel lenses has a single focal length f, each of the light emitting members 110 is located at a predetermined area close to a focal point F of the corresponding Fresnel lens, and the predetermined area P is defined by a length of 70% to 130% based on the focal length f.

Similarly, in the embodiment of FIG. 2B, when the optical path conversion structure 230 is the Fresnel lens having the single focal length f, each of the light emitting members 210 is located at a predetermined area close to a focal point F of the corresponding Fresnel lens, and the predetermined area P is defined by a length of 70% to 130% based on the focal length f. The Fresnel lens, also known as threaded lens, is made as one piece from materials such as resin, polyolefin or glass generally having high transparency, and the Fresnel lens has a great number of minute annular ridges and grooves formed to be concentric in the thinly formed plate formed by injection molding. Also, the bottom face of the Fresnel lens is flat. The Fresnel lens herein referred to is equivalent to a convex lens, and has a thickness as small as several millimeters.

Please refer to FIG. 1C, a divergent light beam L generated by the light emitting member 110 is collimated into a parallel light beam L' (called a collimated light beam) by the optical path conversion structure 130 of the optical path conversion component 13. Videlicet, the optical path conversion component 13 is used for collimating the divergent light beam L generated by each of the light emitting member 110 into the parallel light beam L'.

As shown in FIG. 1C, the optical path conversion component 13 has a light-emitting surface (unnumbered) and a light-incident surface (unnumbered) opposite to the light-emitting surface. The optical path conversion structure 130 may be disposed on at least one of the light-emitting surface and the light-incident surface of the optical path conversion component 13. In the embodiment of the instant disclosure, the optical path conversion structure 130 is disposed on the light-emitting surface. In the optical path conversion structure 130, when viewed from the front, its effective area that directs light beams to a specified direction is formed in a circular shape, which is composed of a convex lens portion 130*a* at a center area thereof and segments 130*b* concentrically arranged around the center area. From the point of view of cross-section of the optical path conversion structure 130, the segments 130*b* are so concentrically arranged as to have a repeated arrangement of the ridges, and top and bottom of the ridge are alternately repeated in a sawtooth form on the segments 130*b*. But in other embodiment, the optical path conversion structure 130 may have other optical structure with similar function. For example, the optical path conversion structure 130 has a curved surface which is protruded from the light-emitting surface or the light-incident surface for collimating the optical path.

Please refer to FIG. 1A and FIG. 1C, the light uniformizing component 14 is disposed above the optical path conversion component 13, the light uniformizing component 14 and the optical path conversion component 13 are separated apart from each other to define a predetermined distance, and the light uniformizing component 14 is disposed on a light path where the parallel light beam L' passes therethrough. The light uniformizing component 14 is provided for scattering and diffusing the parallel light beams L'.

In an embodiment, the light uniformizing component 14 may be a spread lens of the signal indicator, which has a light-incident surface (unnumbered) and a light-emitting surface (unnumbered) opposite to the light-incident surface. The light uniformizing component 14 on the light-incident surface (unnumbered) has a plurality of micro-lens structures 140 for diverging the parallel light beams L' to form into non-parallel light beams (e.g., scattered light beams L"), and the scattered light beams L" are distributed uniformly to form a light emission surface having a uniform illuminance for presenting the indicating pattern. In the embodiment, each of the micro-lens structures 140 has a concave-curved surface, such as a concave spherical surface or a concave aspherical surface, but it is not limited herein. The micro-lens structures 140 also can be formed to have a convex-curved surface which is disposed on the light-incident surface of the light uniformizing component 14. However, in other embodiment, the micro-lens structures 140 may have other optical structure with similar function, or have a surface structure generated by an optical treatment for adjusting the optical path to achieve uniform light-emitting efficacy, so as to comply with specification requirements. An example of the optical treatment is a roughening surface treatment.

In summary, please refer to FIG. 1C, a plurality of divergent light beams L generated from the light emitting member 110 would be collimated into a plurality of parallel light beams L' by the optical path conversion component 13. After that, the parallel light beam L' passes through the light uniformizing component 14 and then generates a plurality of scattered light beams L" to form into a uniform light emission surface for presenting the indicating pattern. In other words, the scattered light beams L" can provide a light emission surface with incandescent look through the light uniformizing component 14.

In another embodiment, the indicating device further includes another secondary optical member (not shown) which is disposed on the light emitting member 110. For example, a lens or a reflector cup which is further used to provide an advantageous light intensity distribution of a light emission surface of the indicating pattern, so as to comply with specification requirements.

In addition, please refer to FIG. 1B, FIG. 1C and FIG. 2B. To illustrate that, in the optical path conversion component 13, 23, each two of the adjacent optical path conversion structures 130, 230 has a connecting line 131, 231 therebetween. When the divergent light beam L generated from the light emitting member 110 (or 210) passes through the connecting line 131 (or 231), it may be deflected to form into a stray light Ls. The stray light Ls generated from the divergent light beam L passing through the connecting line 131 (or 231) is blurred (or homogenized) by the light uniformizing component 14, so as to avoid to generate too low or too high brightness at the connecting line 131 (or 231).

Thus, the number of the light emitting member 110, 210 implemented within the signal indicator according to the present invention can be used less via the use of the optical path conversion component 13, 23 and the light uniformizing component 14, compared to the traditional traffic signal light, to achieve similar light output and to generate the brightness and evenness which meets specification requirements. For example as the indicating pattern having the palm shape, the traditional traffic signal light needs 120 LEDs but the signal indicator of FIG. 1A can only use 28 LEDs; and for example as the indicating pattern having the human shape, the traditional traffic signal light needs 75 LEDs but the signal indicator of FIG. 2A can only use 21 LEDs. In other words, the traditional traffic signal light typically requires highly and densely arranged LEDs. On the contrary, the light emitting members 110, 210 used to form the predetermined patterns of FIG. 1A and FIG. 2A in the instant disclosure does not need highly and densely arranged LEDs, and only few LEDs are dispersedly disposed at different areas. However, even if the light emitting members 110 (or 210) have wider spacing therebetween, the luminance and brightness generated by the signal indicator can be homogenized via the optical path conversion component 13 (or 23) and the light uniformizing component 14, and it also can comply with the specification requirements.

Figure 3A:
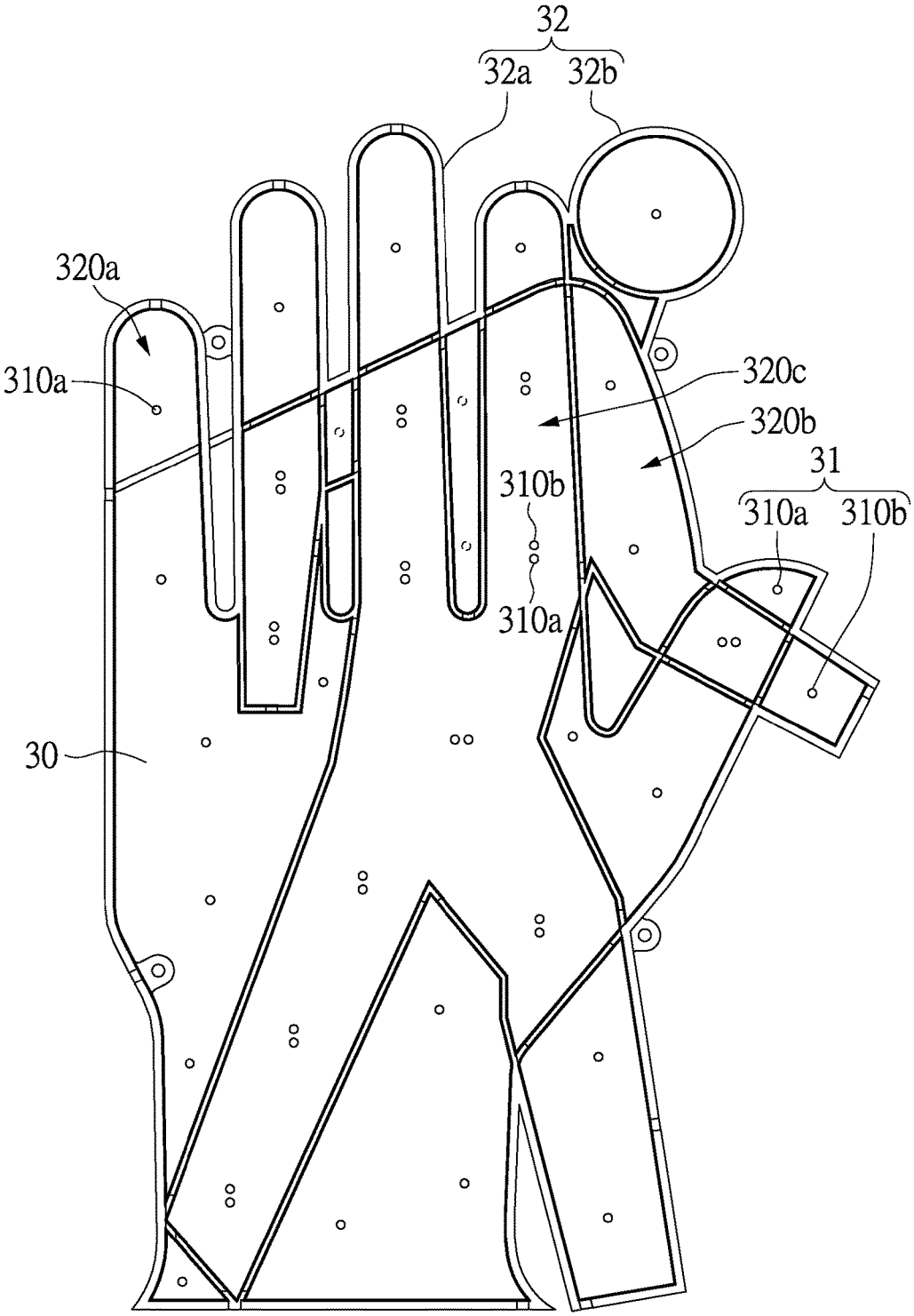
FIG. 3A shows a partial schematic plan view of a signal indicator without a light uniformizing component and an optical path conversion component of a yet another embodiment in the instant disclosure.
Figure 3B:
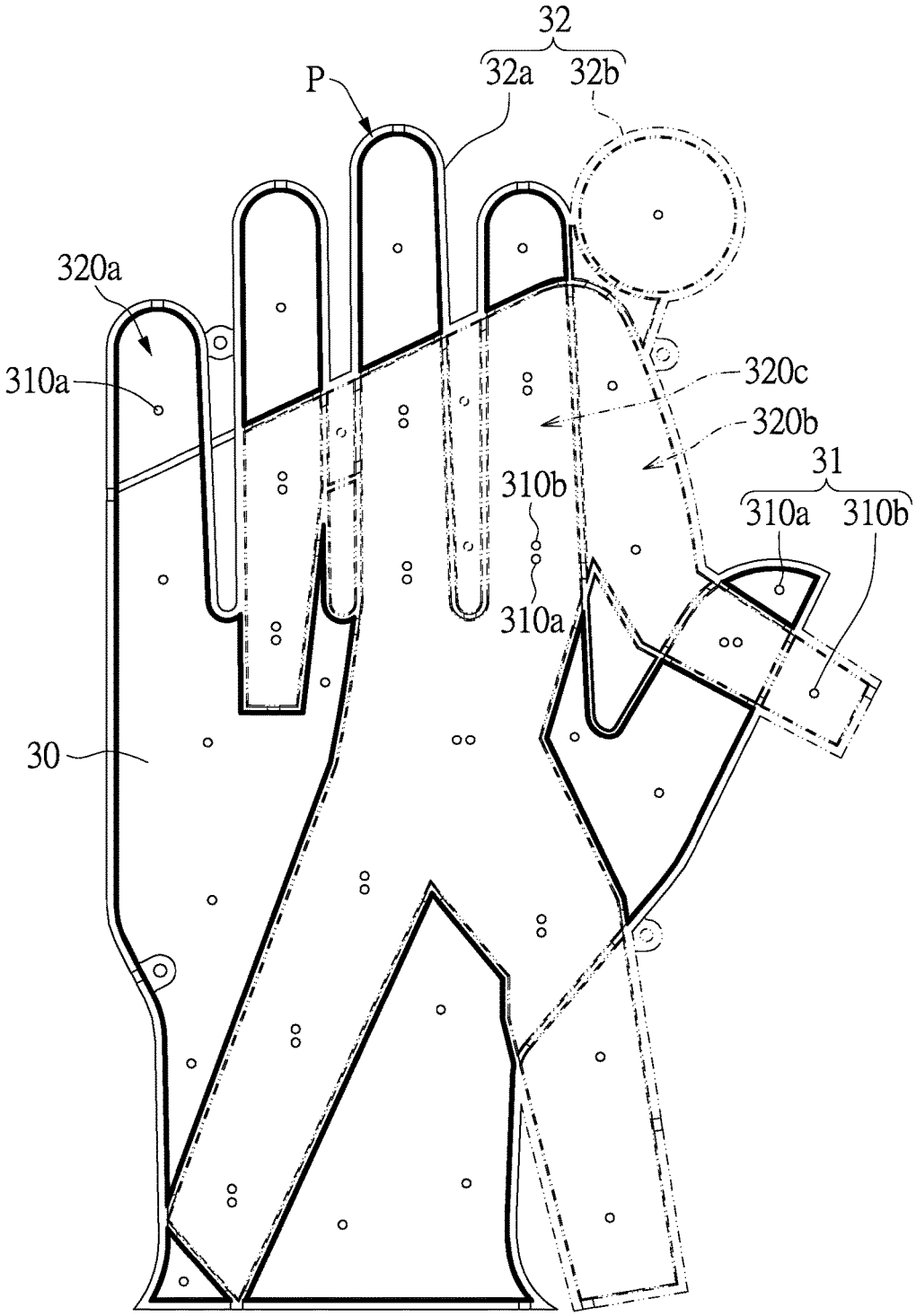
FIG. 3B shows a partial schematic plan view of the signal indicator without the light uniformizing component and the optical path conversion component of the yet another embodiment in the instant disclosure.
Figure 3C:
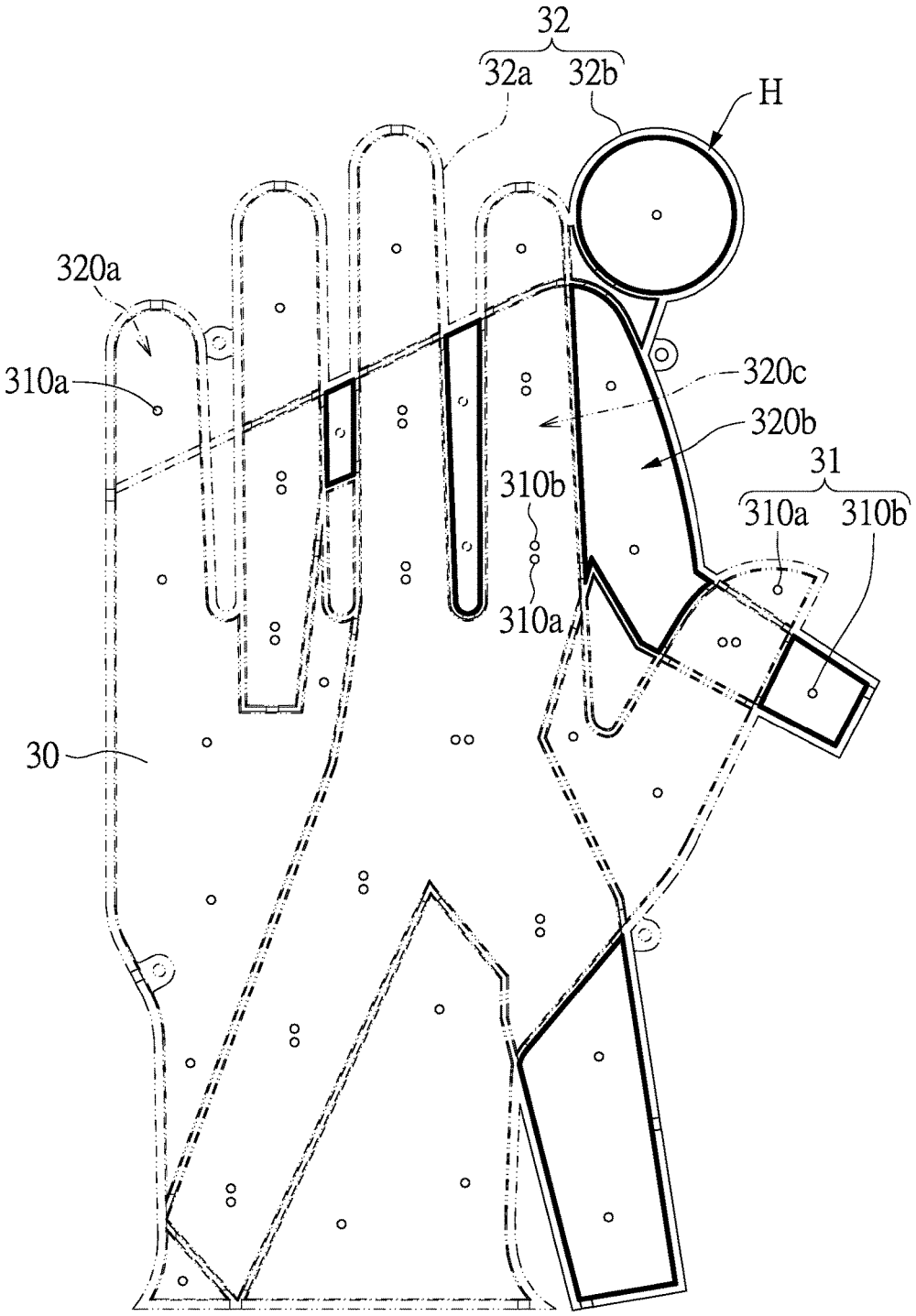
FIG. 3C shows a partial schematic plan view of the signal indicator without the light uniformizing component and the optical path conversion component of the yet another embodiment in the instant disclosure.
Figure 3D:
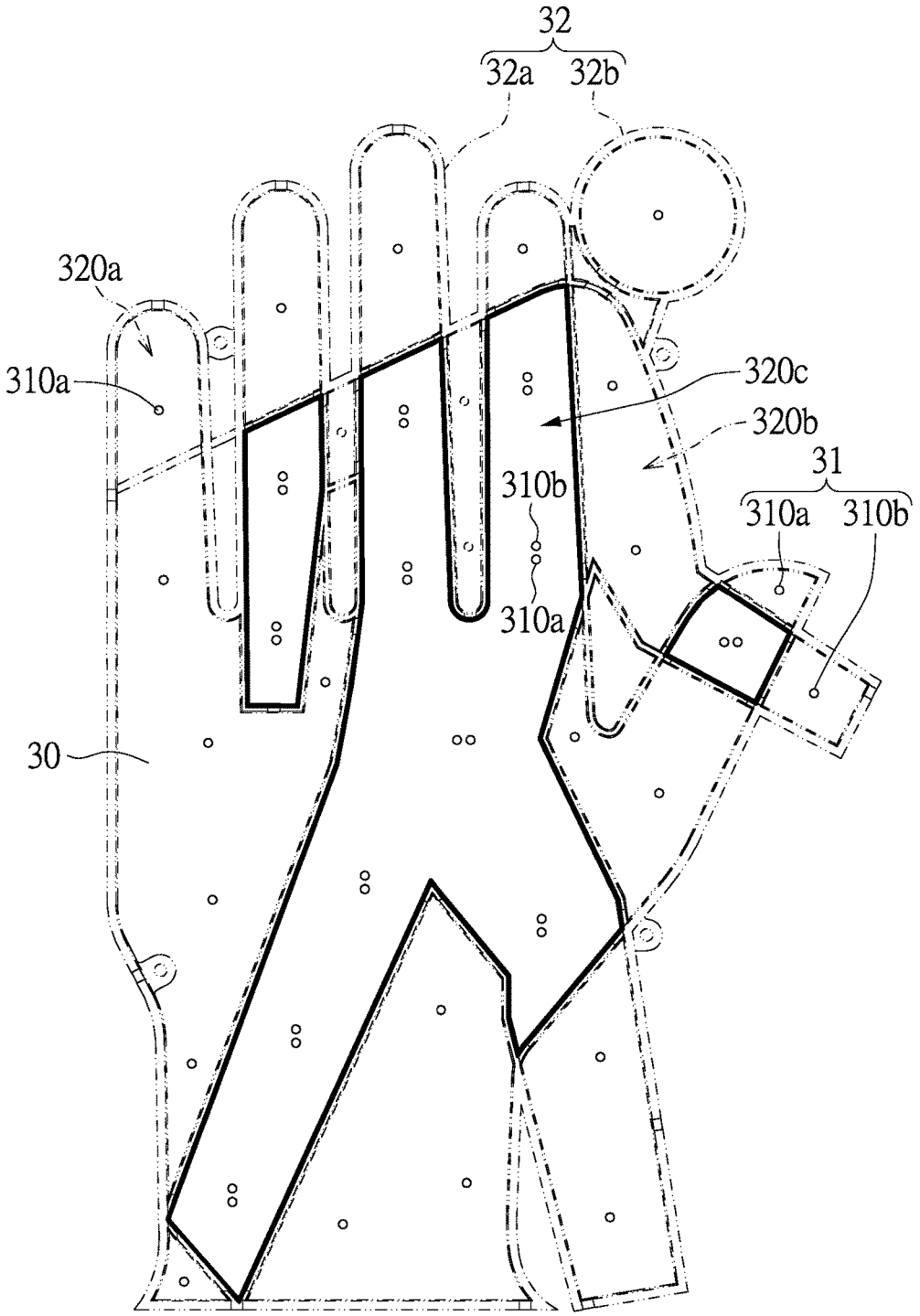
FIG. 3D shows a partial schematic plan view of the signal indicator without the light uniformizing component and the optical path conversion component of the yet another embodiment in the instant disclosure.
Figure 3E:
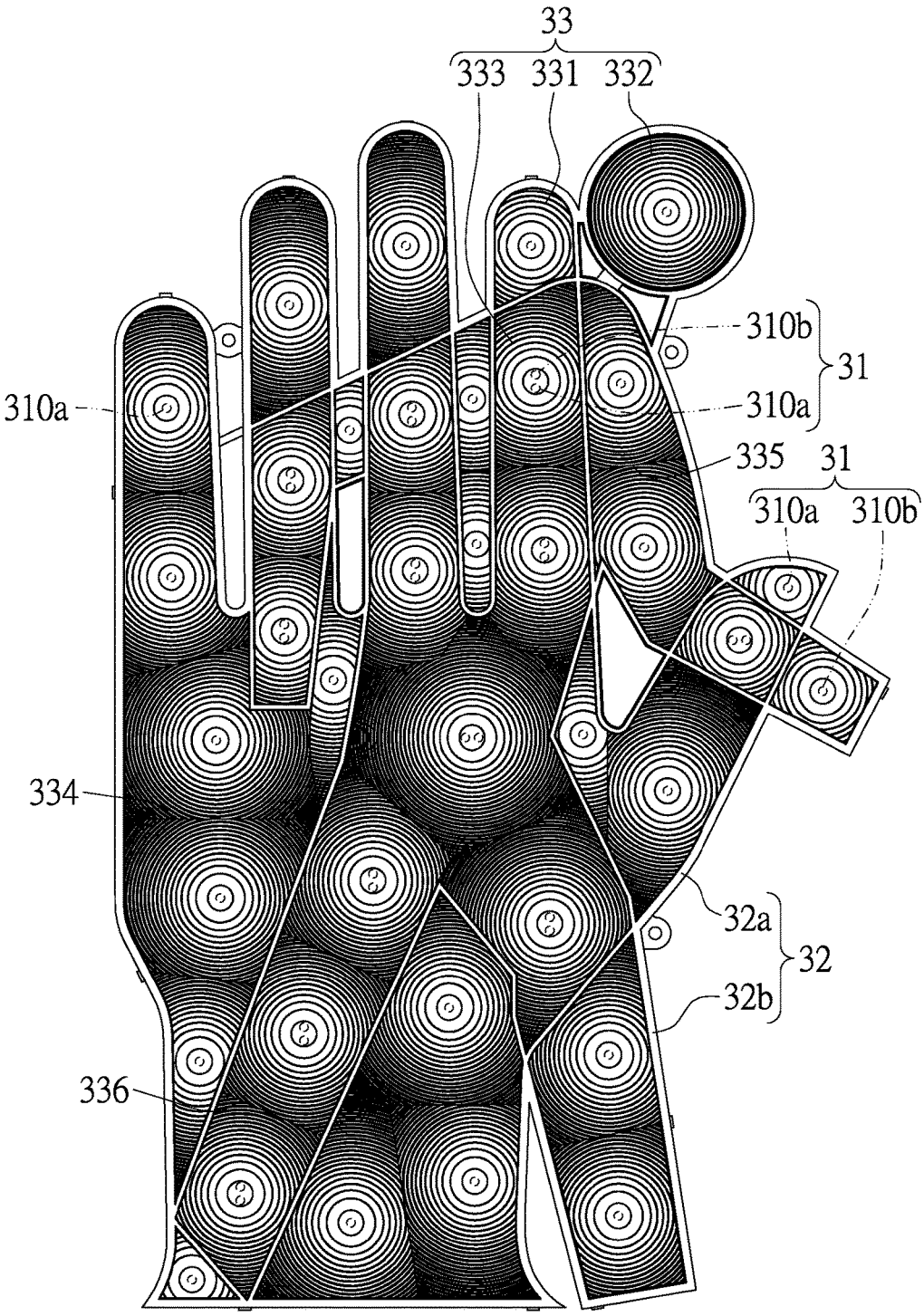
FIG. 3E shows a partial schematic plan view of the signal indicator without the light uniformizing component of the yet another embodiment in the instant disclosure.
Figure 3F:
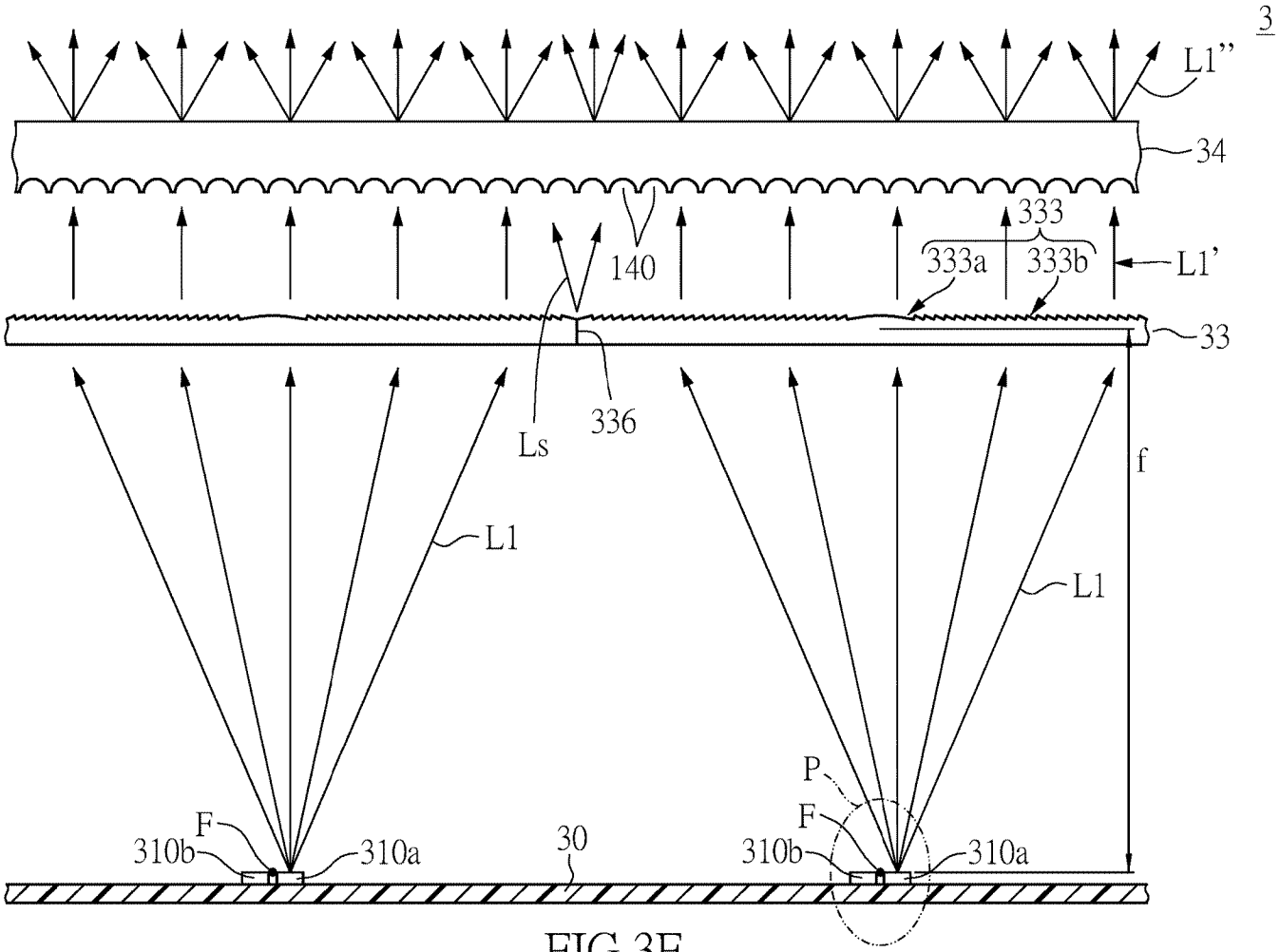
FIG. 3F shows a partial cross-sectional schematic view of the signal indicator at a third accommodating space of the yet another embodiment in the instant disclosure.

Please refer to FIG. 3A to FIG. 3F, FIG. 3A to FIG. 3D show a partial schematic plan view of a signal indicator without a light uniformizing component and an optical path conversion component of an yet another embodiment in the instant disclosure. FIG. 3E shows a partial schematic plan view of the signal indicator without the light uniformizing component of the yet another embodiment in the instant disclosure. FIG. 3F shows a partial cross-sectional schematic view of the signal indicator at a third accommodating space of the yet another embodiment in the instant disclosure.

The signal indicator 3 of the embodiment also includes a circuit substrate 30, a light emitting module 31, a frame 32, an optical path conversion component 33, and a light uniformizing component 34 (as shown in FIG. 3F). More specifically, in FIG. 3A to 3E, although it just shows the partial circuit substrate 30, but the person skilled in the art is familiar with a variety of types of the circuit substrate 30 which can be designed to form into any shapes depending upon requirements. Therefore, the circuit substrate 30 is not limited to the shapes in FIG. 3A and FIG. 3E, and a size of the circuit substrate 30 is larger than a size of the frame 32.

Please refer to FIG. 3A, the pattern defined by the frame 32 includes a first predetermined pattern 32*a* and a second predetermined pattern 32*b*, wherein an example of the first predetermined pattern 32*a* has the palm shape as shown in FIG. 1A, an example of the second predetermined pattern 32*a* has the human shape as shown in FIG. 2A. In the embodiment, the first predetermined pattern 32*a* and the second predetermined pattern 32*b* are at least partially overlapped, thereby forming an overlapping area therebetween.

A difference between the embodiment of FIG. 3A and the embodiments of FIG. 1A and FIG. 2A is that, the frame 32 has a first accommodating space 320*a*, a second accommodating space 320*b*, and a third accommodating space 320*c*. As shown in FIG. 3A, the first and third accommodating spaces 320*a*, 320*c* are cooperatively formed with the first predetermined pattern 32*a*, and the second and third accommodating spaces 320*b*, 320*c* are cooperatively formed with the second predetermined pattern 32*b*.

Please refer to FIG. 3B to FIG. 3D, which respectively show ranges and shapes of the first accommodating space 320*a*, the second accommodating space 320*b*, and the third accommodating space 320*c* defined by the frame 32.

Please refer to FIG. 3B, the first accommodating space 320*a* is defined as that the overlapping area, between the first predetermined pattern 32*a* and the second predetermined pattern 32*b*, are deducted from the first predetermined pattern 32*a*, as shown in solid line in FIG. 3B. Referring to FIG. 3C, in the embodiment, the second accommodating space 320*b* is defined as that the overlapping area, between the first predetermined pattern 32*a* and the second predetermined pattern 32*b*, are deducted from the second predetermined pattern 32*b*, as shown in solid line in FIG. 3C. Please refer to FIG. 3D, the third accommodating space 320*c* is defined by the overlapping area between the first predetermined pattern 32*a* and the second predetermined pattern 32*b*, as shown in solid line in FIG. 3D.

The light emitting module 31 and the frame 32 are both disposed on the circuit substrate 30, wherein the light emitting module 31 is disposed in the first, second and third accommodating spaces 320*a*, 320*b*, 320*c* defined by the frame 32. More in details, the light emitting module 31 includes a plurality of first light emitting members 310*a* and a plurality of second light emitting members 310*b*, wherein the first light emitting members 310*a* are disposed dispersedly on the circuit substrate 30 and are received in the first and third accommodating spaces 320*a*, 320*c*, and the second light emitting members 310*b* are disposed dispersedly on the circuit substrate 30 and are received in the second and third accommodating spaces 320*b*, 320*c*.

As shown in FIG. 3A, in the embodiment, there is only the first light emitting members 310*a* that are disposed in the first accommodating space 320*a*, and there is only the second light emitting members 310*b* that are disposed in the second accommodating space 320*b*. Additionally, a part of first light emitting members 310*a* and a part of second light emitting members 310*b* are both disposed in the third accommodating space 320*c*, and the first light emitting members 310*a* and the second light emitting members 310*b* are adjacently disposed each other.

The first light emitting member 310*a* and the second light emitting member 310*b* can emit different colors of visible light respectively. For example, the first light emitting member 310*a* can emit red light, and the second light emitting member 310*b* can emit green light. The first light emitting members 310*a* and the second light emitting members 310*b* can electrically connect to a control member (not shown) via conducting lines of the circuit substrate 30. The first light emitting member 310*a* and the second light emitting member 310*b* can be selectively switched ON and OFF by the above-mentioned control member.

Please refer to FIG. 3E, the optical path conversion component 33 is disposed on the frame 32, and has a plurality of first optical path conversion structures 331, a plurality of second optical path conversion structures 332, and a plurality of third optical path conversion structures 333. Each of the first optical path conversion structures 331 corresponds to the corresponding first light emitting member 310*a* received in the first accommodating space 320*a*, each of the second optical path conversion structures 332 corresponds to the corresponding second light emitting member 310*b* received in the second accommodating space 320*b*.

Furthermore, referring to FIG. 3F, it shows a partial cross-sectional schematic view of the signal indicator at a third accommodating space of the yet another embodiment in the instant disclosure. As can be seen from the figure, in the third accommodating space 320*c*, the two adjacent first and second light emitting members 310*a*, 310*b* are correspond to the identical third optical path conversion structure 333. That is, each of the third optical path conversion structures 333 corresponds to the corresponding first or second light emitting members 310*a*, 310*b* received in the third accommodating space 320*c*.

The first and third optical path conversion structures 331, 333 arrange into a first indicating pattern P (such as palm shape) which corresponds to the first predetermined pattern 32*a*, and the second and third optical path conversion structures 332, 333 arrange into a second indicating pattern H (such as human shape) which corresponds to the second predetermined pattern 32*b*. In the embodiment, the first indicating pattern P corresponds to the first predetermined pattern 32*a* to show the palm shape, and the second indicating pattern H corresponds to the second predetermined pattern 32*b* to show the human shape.

It is similar to the embodiments of FIG. 1B and FIG. 2B, the first, second, and third optical path conversion structures 331, 332, 333 are disposed on at least one of a light-emitting surface and a light-incident surface of the optical path conversion component 33. Moreover, as shown in FIG. 3E, the first optical path conversion structures 331 are connected with each other, and a first connecting line 334 is formed between the two adjacent first optical path conversion structures 331. Similarly, the second optical path conversion structures 332 are connected with each other, and a second connecting line 335 is formed between the two adjacent second optical path conversion structures 332. The third optical path conversion structures 333 are connected with each other, and a third connecting line 336 is formed between the two adjacent third optical path conversion structures 333.

In this embodiment, the first, second, and third optical path conversion structures 331, 332, 333 are Fresnel lenses. In detailed description, each of the first, second, and third optical path conversion structures 331, 332, 333 have a convex circular surface and a plurality of dentate surfaces arranging into a concentric shape and surrounding the convex circular surface. The third optical path conversion structure 333, from the point of view of cross-section as shown in FIG. 3F, has a convex circular surface 333*a* and a dentate surface 333*b* on the light-emitting surface.

In the embodiment of FIG. 3E, the first, second, and third optical path conversion structures 331, 332, 333 are Fresnel lenses, and each of the Fresnel lenses has a single focal length f. Each of the first light emitting members 310*a* received in the first accommodating space 320*a* and each of the second light emitting members 310*b* received in the second accommodating space 320*b* are located at a predetermined area close to a focal point F of the corresponding Fresnel lens, and the predetermined area P is defined by a length of 70% to 130% based on the focal length f.

Additionally, in the third accommodating space 320*c*, the two adjacent first light emitting members 310*a* and second light emitting members 310*b* are both disposed at the predetermined area P close to a focal point F of the corresponding Fresnel lens, and the predetermined area P is defined by a length of 70% to 130% based on the focal length f. In the embodiment of FIG. 3F, the first light emitting members 310*a* and the second light emitting members 310*b* in the third accommodating space 320*c* are located directly below the convex circular surface 333*a* of the third optical path conversion structure 333.

Furthermore, in the embodiment, the signal indicator 3 includes the light uniformizing component 34 which is disposed above the optical path conversion component 33, and the light uniformizing component 34 and the optical path conversion component 33 are separated apart from each other to define a predetermined distance. Besides, the light-incident surface of the light uniformizing component 34 has a plurality of micro-lens structures 340 (as shown in FIG. 3F) for increasing light uniformity of the signal indicator 3. Each of the micro-lens structures 340 may have a concave-curved surface (e.g., concave spherical surface) or a convex-curved surface.

In particular, in the embodiment, when the first light emitting members 310*a* generate the first divergent light beams L1 and the second light emitting members 310*b* are turned off, the first divergent light beam L1 generated from the first light emitting member 310*a* located in the first accommodating space 320*a* is similar to the embodiment of FIG. 1C, that would be collimated into a first parallel light beam L1' by the first optical path conversion structure 331. In addition, referring to FIG. 3F, the first divergent light beam L1 generated from the first light emitting member 310*a* located in the third accommodating space 320*c* is collimated into the first parallel light beam L1' by the third optical path conversion structure 333. After that, the first parallel light beams L1' corresponding to the first and third optical path conversion structures 331, 333 pass through the light uniformizing component 34 to form into non-parallel light beams (hereinafter called the first scattered light beams L1") to form a first uniform light emission surface for forming the first indicating pattern P.

Identically, when the second light emitting members 310*b* generate the second divergent light beams L2 and the first light emitting members 310*a* are turned off, the second divergent light beam L2 generated from the second light emitting member 310*b* located in the second accommodating space 320*b* is similar to the embodiment of FIG. 1C, that would be collimated into a second parallel light beam L2' by the second optical path conversion structure 332. In addition, referring to FIG. 3G, it shows a partial cross-sectional schematic view of the signal indicator at the third accommodating space of the yet another embodiment in the instant disclosure. As can be seen from the figure, the second divergent light beam L2 generated from the second light emitting member 310*b* located in the third accommodating space 320*c* is collimated into the second parallel light beam L2' by the third optical path conversion structures 333. After that, the second parallel light beams L2' corresponding to the second and third optical path conversion structures 332, 333 pass through the light uniformizing component 34 to form into non-parallel light beams (hereinafter called the second scattered light beam L2") to form a second uniform light emission surface for presenting the second indicating pattern H.

Figure 3G:
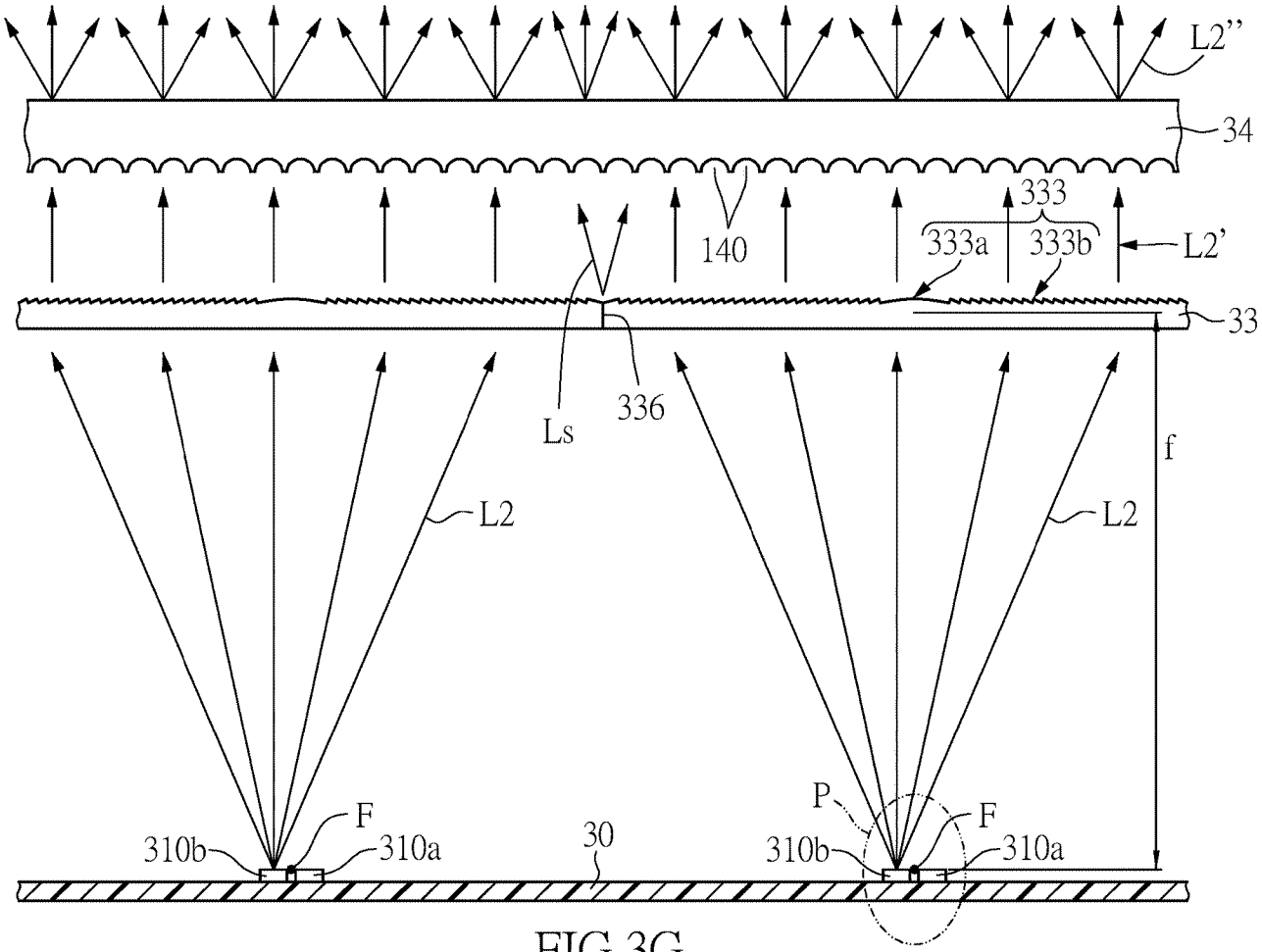
FIG. 3G shows a partial cross-sectional schematic view of the signal indicator at the third accommodating space of the yet another embodiment in the instant disclosure.

Moreover, please refer to FIG. 3E and FIG. 3F (or FIG. 3G). It should be noted that, when the first divergent light beam L1 (or the second divergent light beam L2) generated from the first light emitting member 310*a* (or the second light emitting member 310*b*) passes through the first connecting line 334 between the first optical path conversion structures 331 (or the second connecting line 335 between the second optical path conversion structures 332) and the third connecting line 336 between the third optical path conversion structures 333, it may be deflected to form into a stray light Ls.

The stray light Ls generated from the first divergent light beam L1 passing through the first and third connecting lines 334, 336 (or the second and third connecting lines 335, 336) is blurred (or homogenized) by the light uniformizing component 34, so as to avoid to generate too low or too high brightness at the first and third connecting lines 334, 336 (or the second and third connecting lines 335, 336), and the brightness of the light emission surface of the signal indicator can be uniformized.

In the embodiment, the indicating device further includes another secondary optical member (not shown) which is disposed on the first light emitting member 310*a* (or the second light emitting member 310*b*). For example, a lens or a reflector cup which is further used to present the light intensity distribution of the light emission surface of the indicating pattern, so as to comply with specification requirements.

Furthermore, since the indicating device of the embodiment in the instant disclosure is assembled with the high-power LEDs using a surface mount technology, compared to the traditional traffic signal light, an overall thickness of the indicating device of the embodiment in the instant disclosure is thinner.

In summary, the invention has a beneficial effect that, via the optical path conversion component and the light uniformizing component are disposed at the indicating device of the instant disclosure, the brightness of the indicating pattern of the indicating device can be uniformized. Hence, compared to the traffic signal light of prior art, amounts of the light emitting members used in the signal indicator of the embodiment in the instant disclosure can be reduced by more than half. For example as the indicating pattern having the palm shape, the traffic signal light of the prior art needs 120 LEDs but the signal indicator of the embodiment in the instant disclosure can only use 28 LEDs; and for example as the indicating pattern having the human shape, the traffic signal light of the prior art needs 75 LEDs but the signal indicator of the embodiment in the instant disclosure can only use 21 LEDs. Accordingly, even if the amounts of the light emitting members are reduced in the signal indicator of the embodiment in the instant disclosure, it also can make the light distribution of the light emission surface to meet the specification requirements.

In addition, since the amounts of the light emitting members are reduced, and repeat times of the same procedures for disposing the light emitting members on the circuit substrate also can be reduced, so as to save manufacturing cost and assembling time. Besides that, the instant disclosure uses the optical path conversion structure and the light uniformizing component to uniformize the light emitting distribution of the indicating device. Therefore, the use of the LEDs having different brightness does not influence the light emitting distribution too much, such that to choose LEDs becomes easier.

The descriptions illustrated supra set forth simply the preferred embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. An indicating device, comprising:

a circuit substrate;

a frame disposed on the circuit substrate, wherein the frame has an accommodating space for forming a predetermined pattern;

a light emitting module including a plurality of light emitting members disposed dispersedly on the circuit substrate and received in the accommodating space;

an optical path conversion component disposed on the frame and above the plurality of light emitting members, wherein the optical path conversion component has a plurality of optical path conversion structures respectively corresponding to the light emitting members, and the optical path conversion structures arrange into an indicating pattern which corresponds to the predetermined pattern; and an light uniformizing component disposed above the optical path conversion component, and the light uniformizing component and the optical path conversion component being separated apart from each other to define a predetermined distance;

wherein each of the light emitting members generates a divergent light beam passing through the corresponding optical path conversion structures to collimate into a parallel light beam, and the parallel light beams are adjusted into non-parallel light beams through the light uniformizing component for forming a uniform light emission surface presenting the indicating pattern.

2. The indicating device as claimed in claim 1, wherein the optical path conversion structures are connected to one another, adjacent optical path conversion structures have a connecting line therebetween, the divergent light beam passing through the connecting line is formed a stray light, and the stray light is homogenized by the light uniformizing component.

3. The indicating device as claimed in claim 1, wherein the light uniformizing component has a light-incident surface having a plurality of micro-lens structures.

4. The indicating device as claimed in claim 3, wherein each of the micro-lens structures has a concave-curved surface or a convex-curved surface.

5. The indicating device as claimed in claim 1, wherein the optical path conversion structures are disposed on a light-emitting surface of the optical path conversion component, each of the optical path conversion structures has a convex circular surface and a plurality of dentate surfaces concentrically arranged surrounding the convex circular surface.

6. The indicating device as claimed in claim 5, wherein the optical path conversion structure is a Fresnel lens.

7. The indicating device as claimed in claim 6, wherein the Fresnel lens has a focal length, and each of the light emitting members is located at a predetermined area close to a focal point of the corresponding Fresnel lens.

8. The indicating device as claimed in claim 7, wherein the predetermined area is centered about the focal point of the corresponding Fresnel lens and defined by a dimension having length of 70% to 130% of the focal length of such corresponding Fresnel lens.

9. The indicating device as claimed in claim 1, wherein the accommodating space is divided into a first accommodating space, a second accommodating space, and a third accommodating space, the first and third accommodating spaces cooperatively forming a first predetermined pattern, and the second and third accommodating spaces cooperatively forming a second predetermined pattern, wherein the first predetermined pattern and the second predetermined pattern at least partially overlapping;

wherein the light emitting members are divided into a plurality of first light emitting members and a plurality of second light emitting members, the first light emitting members are disposed dispersedly on the circuit substrate and are received in the first and third accommodating spaces, and the second light emitting members are disposed dispersedly on the circuit substrate and are received in the second and third accommodating spaces;

wherein the optical path conversion structures are divided into a plurality of first optical path conversion structures, a plurality of second optical path conversion structures, and a plurality of third optical path conversion structures, each of the first optical path conversion structures corresponds to the corresponding first light emitting member received in the first accommodating space, each of the second optical path conversion structures corresponds to the corresponding second light emitting member received in the second accommodating space, and each of the third optical path conversion structures corresponds to the corresponding first and second light emitting members received in the third accommodating space, wherein the first and third optical path conversion structures arrange into a first indicating pattern which corresponds to the first predetermined pattern, and the second and third optical path conversion structures arrange into a second indicating pattern which corresponds to the second predetermined pattern;

wherein each of the first light emitting members generates a first divergent light beam passing through the corresponding first and third optical path conversion structures to collimate into a first parallel light beam, and the first parallel light beams are adjusted into non-parallel light beams through the light uniformizing component for forming a first uniform light emission surface presenting the first indicating pattern;

wherein each of the second light emitting members generates a second divergent light beam passing through the corresponding second or third optical path conversion structures to collimate into a second parallel light beam, and the second parallel light beams are adjusted into non-parallel light beams through the light uniformizing component for forming a second uniform light emission surface presenting the second indicating pattern.

10. The indicating device as claimed in claim 9, wherein the first light emitting member and the second light emitting member emit light of different colors.

11. The indicating device as claimed in claim 9, wherein the first light emitting members and the second light emitting members are disposed in the third accommodating space and adjacent to one another and correspond to a single third optical path conversion structure.

12. The indicating device as claimed in claim 9, wherein the first predetermined pattern has a palm shape, and the second predetermined pattern has a human shape.

13. The indicating device as claimed in claim 9, wherein the light uniformizing component has a light-incident surface having a plurality of micro-lens structures.

14. The indicating device as claimed in claim 13, wherein each of the micro-lens structures has a concave-curved surface or a convex-curved surface.

15. The indicating device as claimed in claim 9, wherein the first, second, and third optical path conversion structures are disposed on a light-emitting surface of the optical path conversion component, each of the first, second, and third optical path conversion structures have a convex circular surface and a plurality of dentate surfaces concentrically arranged surrounding the convex circular surface.

16. The indicating device as claimed in claim 15, wherein the first, second, and third optical path conversion structures are Fresnel lenses.

17. The indicating device as claimed in claim 16, wherein each of the Fresnel lens has a focal length, and each of the first light emitting members and each of the second light emitting members are located at a predetermined area close to a focal point of the corresponding Fresnel lens.

18. The indicating device as claimed in claim 17, wherein the predetermined area is centered about the focal point of the corresponding Fresnel lens and defined by a dimension having length of 70% to 130% of the focal length of such corresponding Fresnel lens.

* * * * *